US005671722A

United States Patent [19]

Moody

[11] Patent Number: 5,671,722

[45] Date of Patent: Sep. 30, 1997

[54] PROJECTILE LAUNCHER

[75] Inventor: Paul E. Moody, Barrington, R.I.

[73] Assignee: The United States of America as represented by the Secretary of the Navy, Washington, D.C.

[21] Appl. No.: 655,103

[22] Filed: May 29, 1996

[51] Int. Cl.[6] ..... F41B 7/04

[52] U.S. Cl. ..... 124/22; 124/17

[58] Field of Search ..... 124/17, 20.1, 20.3, 124/21, 22

[56] References Cited

U.S. PATENT DOCUMENTS

| | | | |
|---|---|---|---|
| 2,540,303 | 2/1951 | Sylvester | 124/21 |
| 3,006,330 | 10/1961 | DeBach | 124/22 |
| 4,050,438 | 9/1977 | Pfotenhauer | 124/20.1 |
| 4,411,248 | 10/1983 | Kivenson | 124/20.1 |
| 4,662,344 | 5/1987 | Mitchell | 124/22 |
| 5,123,643 | 6/1992 | Heilhecker et al. | 124/21 X |
| 5,531,209 | 7/1996 | Liedtke | 124/20.1 |

*Primary Examiner*—John A. Ricci
*Attorney, Agent, or Firm*—Michael J. McGowan; James M. Kasischke; Prithvi C. Lall

[57] ABSTRACT

A projectile launching apparatus has a barrel for supporting a projectile prior to and during launch. The barrel is defined by a breech end, a muzzle end and a longitudinal launch axis along which the projectile is launched. A length of elastomeric material is fixed at its ends to opposing sides of the barrel aft of the muzzle end. Linear actuators are aligned parallel to and on opposite sides of the barrel. A guide or pulley is mounted on each of the linear actuators for linear movement therewith to positions forward of the ends of the elastomeric material. Third and fourth guides or pulleys are fixed by a frame such that the fourth pulley is positioned aft of the third pulley along the longitudinal launch axis. The elastomeric material is led along a path from one fixed end, about the first pulley, between the third and fourth pulleys, and about the second pulley to where the elastomeric material terminates at its other fixed end. When the frame is drawn toward the breech end of the apparatus, the third pulley and the fourth pulley are simultaneously drawn towards the breech end to stretch the elastomeric material. The stretched elastomeric material creates the potential for accelerating the projectile towards the muzzle end for a projectile placed forward of the third pulley.

13 Claims, 5 Drawing Sheets

PROJECTILE LAUNCHER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to launching mechanisms, and more particularly to a projectile launcher using a stretched elastomeric band for creating the launch potential.

(2) Description of the Prior Art

In addition to launching torpedoes, submarines typically launch a variety of signal buoys and other small projectiles. The launching apparatus must be capable of ejecting the projectile at a velocity sufficient to overcome the boundary layer of the submarine regardless of the submarine's velocity and depth. However, since the signal buoys and other small projectiles typically are not equipped with their own drive system, the launching apparatus must be capable of developing a variety of exit velocities based on the type of projectile, speed and depth of the submarine, etc.

SUMMARY OF THE INVENTION

Accordingly, it is an object of the present invention to provide a projectile launching apparatus.

Another object of the present invention is to provide a projectile launching apparatus capable of achieving a range of exit velocities at launch.

Other objects and advantages of the present invention will become more obvious hereinafter in the specification and drawings.

In accordance with the present invention, a projectile launching apparatus has a barrel for supporting a projectile prior to and during launch. The barrel is defined by a breech end, a muzzle end and a longitudinal launch axis along which the projectile is launched. A length of elastomeric material is fixed at a first end and at a second end on opposing sides of the barrel aft of the muzzle end. A first linear actuator is aligned parallel to the barrel. A first guide or pulley is mounted on the first linear actuator for linear movement therewith to positions forward of the first end of the length of elastomeric material. In a similar fashion, a second linear actuator is aligned parallel to the barrel on an opposite side of the barrel relative to the first linear actuator. A second pulley is mounted on the second linear actuator for linear movement therewith to positions forward of the second end of the length of elastomeric material. Third and fourth pulleys are fixed by a frame such that the fourth pulley is positioned aft of the third pulley along the longitudinal launch axis. The frame also allows the third pulley and the fourth pulley to rotate in a common plane. The length of elastomeric material is led from its first end to its second end along a path about the first pulley, between the third pulley and the fourth pulley, and about the second pulley. When the frame is drawn toward the breech end of the apparatus, the third pulley and the fourth pulley are simultaneously drawn towards the breech end to stretch the length of elastomeric material. The stretched elastomeric material creates the potential for accelerating the projectile towards the muzzle end when the projectile is placed on the frame forward of the third pulley.

BRIEF DESCRIPTION OF THE DRAWING(S)

Other objects, features and advantages of the present invention will become apparent upon reference to the following description of the preferred embodiments and to the drawings, wherein.

DESCRIPTION OF THE PREFERRED EMBODIMENT(S)

Figure 1:
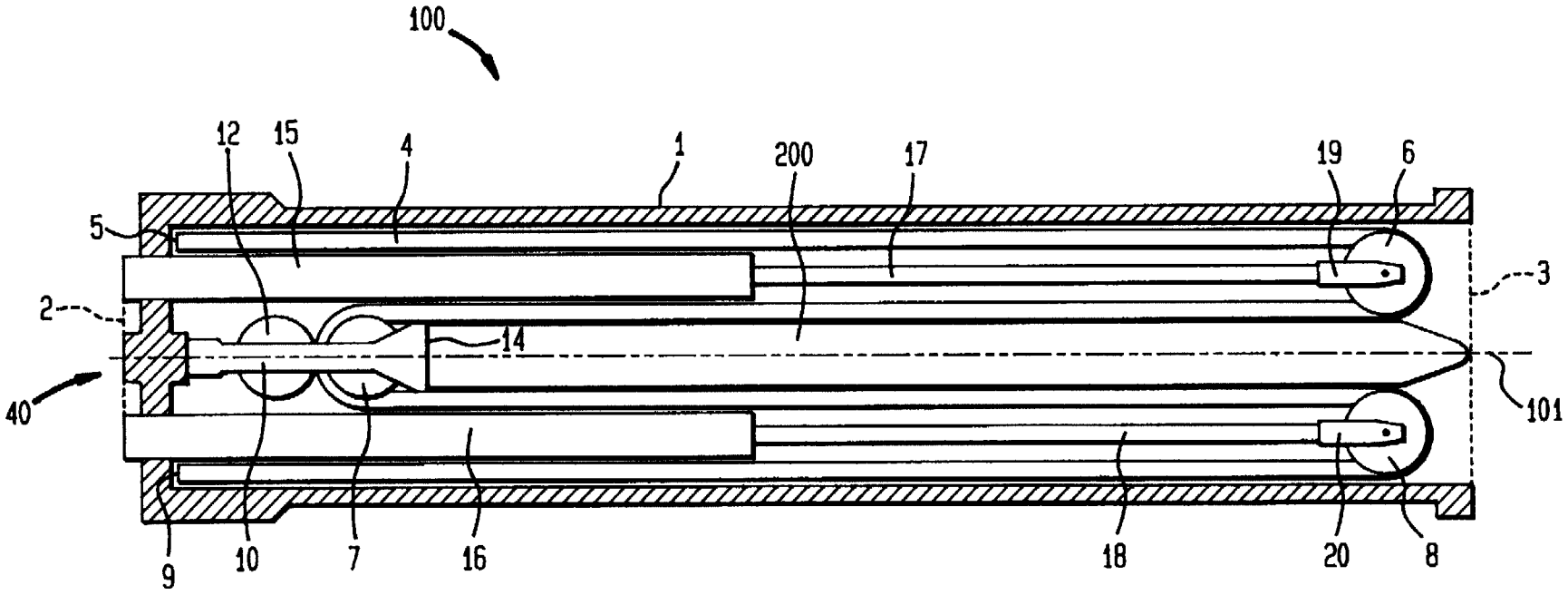
FIG. 1 is in-part a cross-sectional view and in-part a side view of the projectile launching apparatus according to the present invention prior to launch.

Referring now to the drawings, and more particularly to FIG. 1, an embodiment of the projectile launcher of the present invention is shown referenced generally by numeral 100. Launcher 100 will be described relative to its advantages for use in submarines. However, it is to be understood that launcher 100 can be used to launch projectiles from any platform into an air or water environment. Launcher 100 includes cylindrical tube 1 which forms both the housing and launch barrel for launcher 100. The launch axis of launch 100 is indicated by dashed line 101.

Tube 1 is sealed at its breech end which is referenced by dashed line 2. Tube 1 is open at its muzzle end which is referenced by dashed line 3. Elastomeric band 4 is a single elastomeric member made of urethane or other suitable elastic. Band 4 is generally secured on one end thereof at location 5 and on the other end thereof at location 9. Locations 5 and 9 are located at or near breech end 2 on opposing sides of launch axis 101 in a common plane that generally passes through launch axis 101. As will become more apparent from the following description, band 4 provides the launch potential for projectile 200.

A plurality of guides or pulleys are positioned on launcher 100 to define a path for band 4 between locations 5 and 9. Pulleys 6 and 8 are disposed on opposing sides of launcher 100 at positions forward of locations 5 and 9, respectively. Pulleys 7 and 12 are positioned such that pulley 12 is aft of pulley 7.

Pulley 6 is mounted on the end of a piston rod 17 of a linear actuator 15 by means of a yoke 19. In a similar fashion, a pulley 8 is mounted on the end of a piston rod 18 of a linear actuator 16 by means of a yoke 20. Yokes 19 and 20 allow for rotation of pulleys 6 and 8, respectively, in a plane passing through launch axis 101. Actuators 15 and 16 are aligned on opposing sides of launch axis 101 and are operated to position pulleys 6 and 8, respectively, between breech end 2 and muzzle end 3. Typically, pulleys 6 and 8 are positioned equi-distant from muzzle end 3.

Pulleys 7 and 12 are mounted adjacent and in fixed opposition to one another in a mirror image fashion by means of frame 10. Frame 10 allows for rotation of pulleys 7 and 12 in the same plane as that used for the rotation of pulleys 6 and 8. Frame 10 includes a pusher end 14 which cooperates with the tail end of projectile 200 during a launch. In the ready-to-fire position shown in FIG. 1, frame 10 is located at or near breech end 2 along launch axis 101 by means of a locking mechanism 40. Locking mechanism 40 can be, for example, a standard ball-lock mechanism as will be described further below.

The path of band 4 extends from location 5 around pulley 6, between pulleys 7 and 12, and around pulley 8 to its termination at location 9. In the ready-to-launch position shown in FIG. 1, band 4 is stretched and is wrapped around the aft or breechward end of pulley 7. The amount of stretch, i.e., launch potential, of band 4 can be adjusted by adjusting the position of pulleys 6 and 8 (between breech end 2 and muzzle end 3) using linear actuators 15 and 16, respectively.

Figure 2:
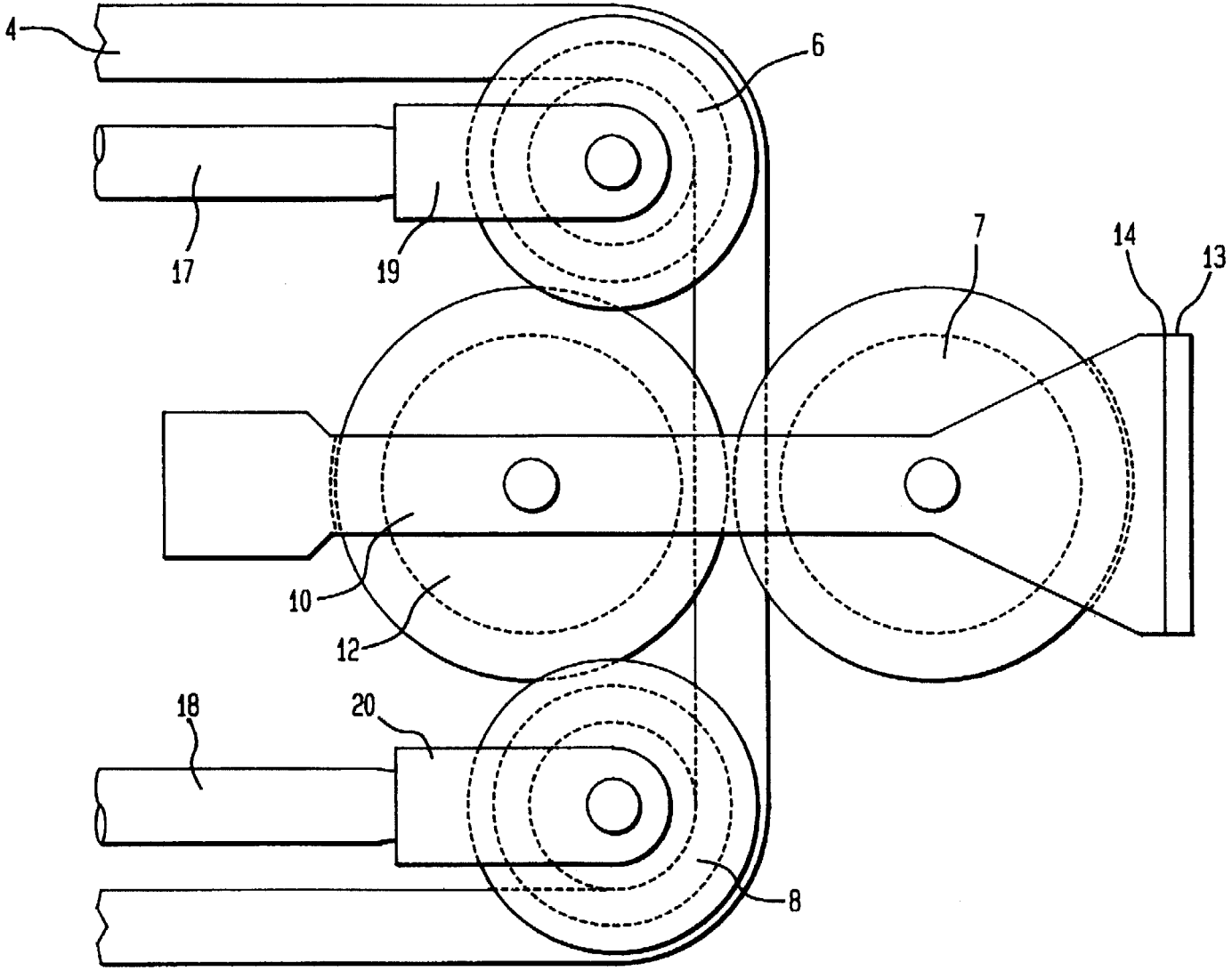
FIG. 2 is a side view of a portion of the projectile launching apparatus as it would appear at the completion of a launch ejection stroke.

In operation, linear actuators 15 and 16 are operated to position pulleys 6 and 8 for the proper amount of stretch of band 4. As pulleys 6 and 8 are moved towards muzzle end 3, tension in band 4 increases as does the launch potential. When frame 10 is released by locking mechanism 40 from the position shown in FIG. 1, the tension in band 4 will cause frame 10, pulleys 7/12 and projectile 200 to be propelled towards muzzle end 3. As shown in FIG. 2, the aft end of pulley 7 passes the forward or muzzleward ends of pulleys 6 and 8 to complete the ejection stroke of launcher 100. However, even though the ejection stroke is completed, the forward inertia of frame 10 and pulleys 7/12 will cause these components to continue to move towards muzzle end 3. (Typically, the length of band 4 and/or the positions of pulleys 6 and 8 are such that band 4 is still in tension at completion of the ejection stroke). When this occurs, band 4 will cease to be wrapped around pulley 7 and begin to wrap around pulley 12. This will result in a gradual deceleration of frame 10 and pulleys 7/12 so that water hammer will not occur at the end of the ejection stroke.

During deceleration of frame 10 and pulleys 7/12, pusher end 14 ceases to physically push on the aft end of projectile 200 while the ejection potential imparted to projectile 200 will cause same to exit launcher 100. Once frame 10 and pulleys 7/12 have decelerated to a zero muzzleward velocity, band 4 will cause frame 10 and pulleys 7/12 to be pulled towards breech end 2. Frame 10 and pulleys 7, 12 will oscillate at decreasing speed and travel distances until band 4 settles to a position between pulleys 7 and 12 but not wrapped around either of pulleys 7 and 12.

Figure 3:
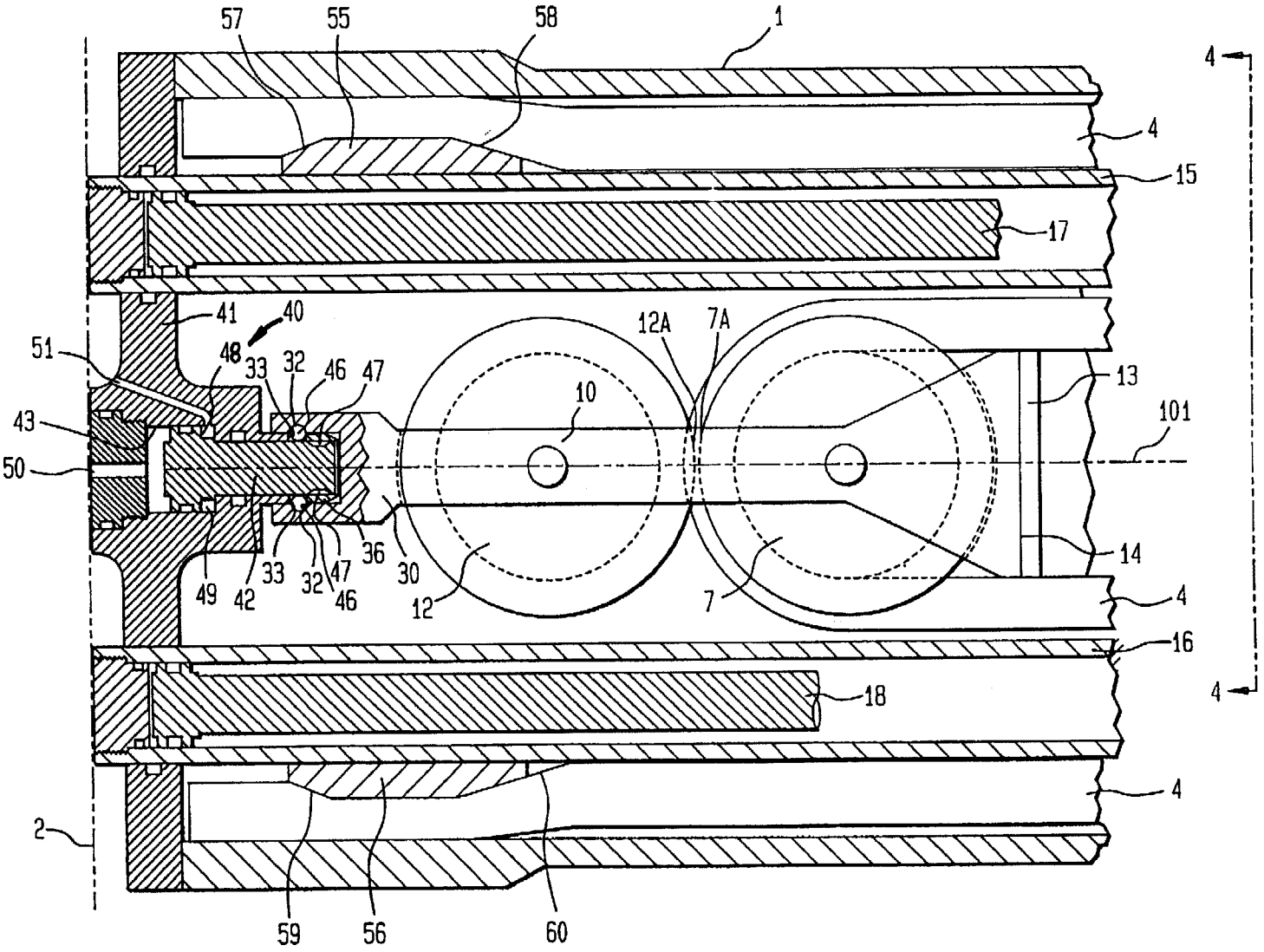
FIG. 3 is a more detailed view of the breech end of the projectile launching apparatus prior to launch.

The portion of launcher 100 near breech end 2 is shown in the ready-to-launch position in greater detail in FIG. 2 where like reference numerals are used for those elements already described above. FIG. 3 is provided to illustrate details not illustrated in FIG. 1. By way of example, locking mechanism 40 can be a standard ball-lock mounted in breech end 2 between linear actuators 15 and 16. Locking mechanism 40 includes a housing 41 and a piston pin 42 fitted within interior bore 43 of housing 41. Piston pin 42 has a series of holes 47 located radially around its periphery in which balls 46 are captured. Piston pin 42 further has an annular flange 48 that cooperates with bore 43 to define annular chamber 49 about piston pin 42. In the locked position shown, balls 46 extend into annular groove 32 provided on the inside of a socket 30 which forms the aft end of frame 10. To maintain piston pin 42 in engagement with socket 30, pressure is applied to the aft end of piston pin 42 via a port 50 in housing 41. To release piston pin 42 from socket 30, i.e., to effect a launch, pressure is relieved from port 50 and is instead applied to port 51. Pressure applied through port 51 pressurizes annular chamber 49 to cause piston pin 42 to move towards breech end 2 and out of engagement with socket 30.

It is also apparent in FIG. 3, that frame 10 positions aft or breechward end 7A of pulley 7 and forward or muzzleward end 12A of pulley 12 in close proximity to one another such that band 4 is trapped therebetween regardless of the position of frame 10 along launch axis 101. Another feature detailed in FIG. 3 is elastomeric disk 13 affixed to the end face of pusher 14. Disk 13 cushions the ejection force imparted to projectile 200 and helps to uniformly distribute such ejection force. Also shown in FIG. 3 are clamps 55 and 56 for securing band 4 at locations 5 and 9, respectively. Clamp 55 is contoured at areas 57 and 58 to prevent stress concentrations in band 4. Similarly, clamp 56 is contoured at areas 59 and 60. It may also be desirable to manufacture band 4 with slightly recessed areas (for receiving clamps 55 and 56) to ensure that band 4 does not slip over clamps 55 and 56 when under tension.

Figure 4:
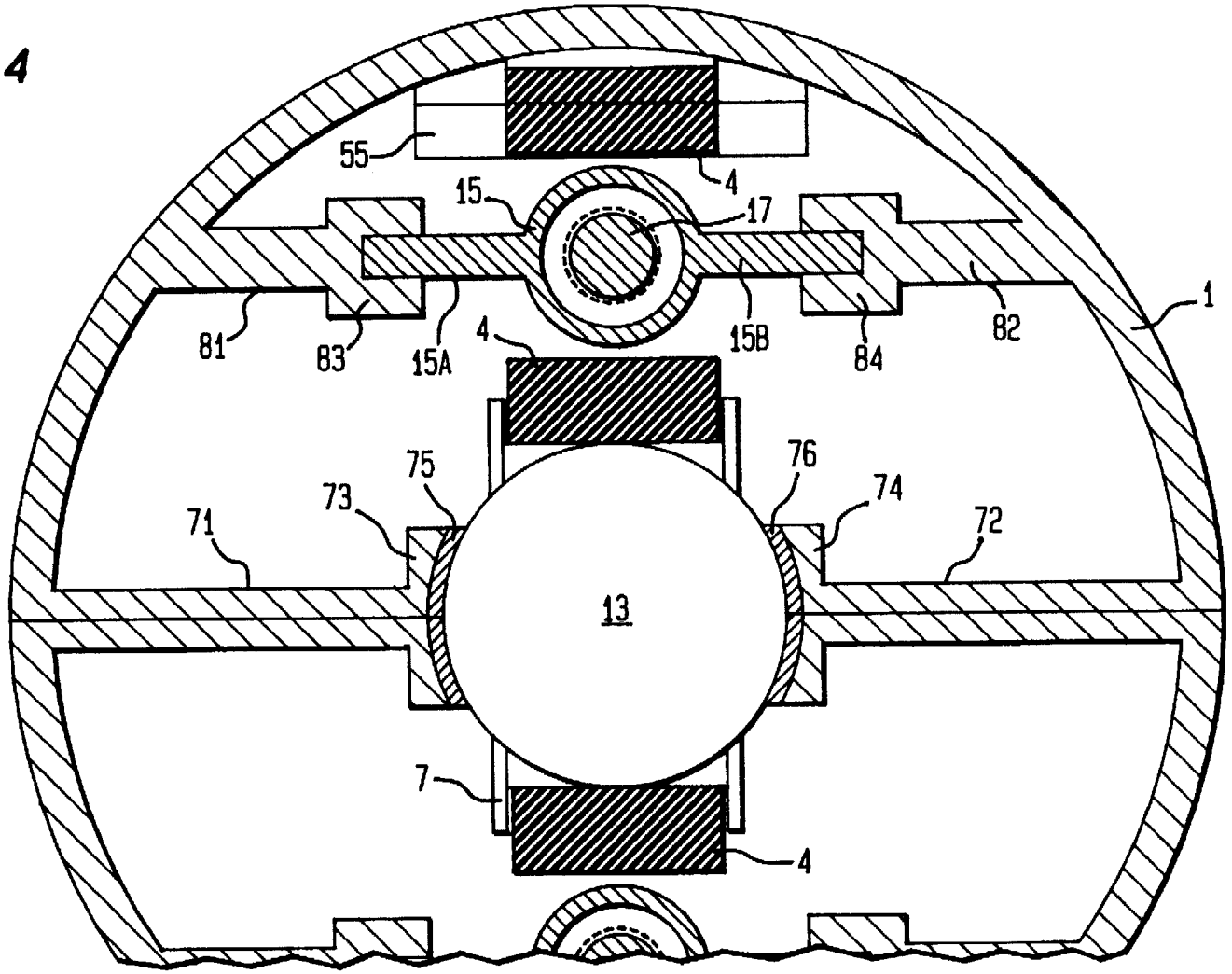
FIG. 4 is a cross-sectional view taken along line 4—4 of FIG. 3.

In FIG. 4, additional details of the present invention are shown. Once again, common reference numerals are used for common elements. Guiding frame 10 and projectile 200 during a launch are guides 71 and 72 that are supported on or integral with (as shown) tube 1 along the length of tube 1. Guides 71 and 72 can be shaped on their respective ends 73 and 74 to match the shape of frame 10. For example, the outer edges of frame 10 (as well as pusher 14) could have the same curvature as that of projectile 200. In this way, guides 71 and 72 serve to guide not only frame 10, but also projectile 200 during a launch. Ends 73 and 74 can respectively be terminated with bearing pads 75 and 76.

Also shown in FIG. 4 are foundations 81 and 82 supported on or integral with (as shown) tube 1 along the length of tube 1. Foundations 81 and 82 support flanges 15A and 15B of linear actuator 15 at the breechward end of launcher 100. Further, the respective U-shaped ends 83 and 84 of foundations 81 and 82 can be used as keyed guides for pulley 6 in its area of travel. Typically, yoke 19 could be provided with a key (not shown in the drawings) that would cooperate with U-shaped ends 83 and 84. Note that similar foundations would be provided for linear actuator 16 and pulley 8.

Figure 5:
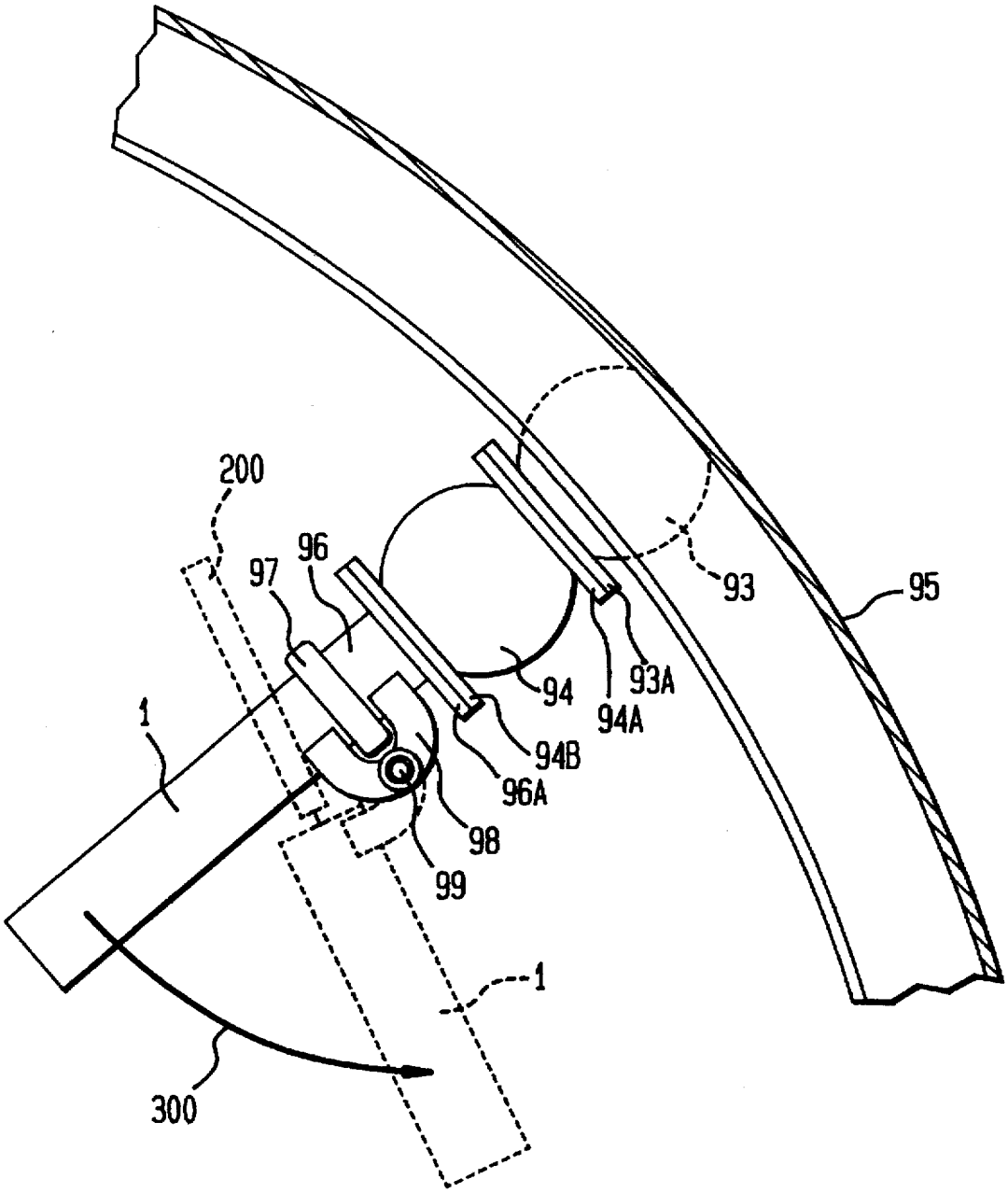
FIG. 5 is a plan view of an example of how the present invention is loaded when installed in the hull of a ship.

FIG. 5 depicts a typical installation of the projectile launcher of the present invention as it could be installed and used in the hull 95 of a ship. A hull valve 93 is shown welded to hull 95 and a back-up valve 94 is attached, e.g., bolted, between hull valve 93 and an extension pipe 96. (Both hull valve 93 and back-up valve 94 are generally used to conform to safety requirements.) More specifically, flange 93A of hull valve 93 is attached to flange 94A of back-up valve 94. Flange 94B of back-up valve 94 is attached to flange 96A of extension pipe 96. Extension pipe 96 is equipped with a locking ring 97 which can be configured similarly to existing launchers. A hinge 98 is fixed to extension pipe 96 and tube 1 of launcher 100. Hinge 98 is capable of pivoting about hinge point 99.

In the loading position (shown in phantom in FIG. 5), a rotary actuator (not shown) pivots tube 1 about hinge point 99 as indicated by arrow 300 and projectile 200 is muzzle-loaded through muzzle end 3. (During loading, frame 10 is locked at the breech end of tube 1 as shown in FIGS. 1 and 3.) Once loaded, tube 1 is rotated to the ready-to-launch position in-line with extension pipe 96 where tube 1 is locked into position by locking ring 97. Prior to launching projectile 200, valves 93 and 94 are opened to flood tube 1 and the elastomeric band contained within tube 1 is stretched to the desired launch tension as described above.

The advantages of the present invention are numerous. The system uses low-cost components to achieve a variable exit-velocity projectile launcher. The deceleration feature of the present invention will prevent water hammer from recurring when the launcher is used in an underwater environment. The launcher's simple construction will provide for simple operation and maintenance.

Although, the invention has been described relative to a specific embodiment, it is not so limited. For example, the pulleys could be replaced with simple contoured guides. Also, additional clamps similar to clamps 55 and 56 could be provided along the length of the launcher in order to provide additional means of adjusting the tension in band 4. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A projectile launching apparatus, comprising:

a barrel for supporting a projectile prior to and during launch thereof, said barrel having a breech end, a muzzle end and a longitudinal launch axis along which said projectile is launched;

a length of elastomeric material fixed at a first end and at a second end on opposing sides of said barrel aft of said muzzle end;

a plurality of guides for guiding said length of elastomeric material between said first end and said second end, said plurality of guides including a first guide positioned in said barrel closer to said muzzle end than said first end of said length of elastomeric material, a second guide positioned in said barrel closer to said muzzle end than said second end of said length of elastomeric material, a third guide positioned along said longitudinal launch axis, and a fourth guide positioned aft of said third guide along said longitudinal launch axis in a fixed mirror image fashion relative to said third guide, wherein said third guide and said fourth guide are capable of coincidental movement within said barrel along said longitudinal launch axis; and said length of elastomeric material extending from said first end to said second end along a path about said first guide, between said third guide and said fourth guide, and about said second guide, whereby said third guide and said fourth guide can be drawn towards said breech end to stretch said length of elastomeric material to create a potential for accelerating said projectile towards said muzzle end when said projectile is placed forward of said third guide.

2. A projectile launching apparatus as in claim 1 further comprising means for adjusting the position of said first guide and said second guide between said breech end and said muzzle end.

3. A projectile apparatus as in claim 1 further comprising a mechanism for maintaining said third guide and said fourth guide in a locked position when said length of elastomeric material is stretched, and for releasing said third guide and said fourth guide from said locked position when said projectile is to be launched, said maintaining mechanism being disposed in said barrel between said fourth guide and said breech end.

4. A projectile launching apparatus as in claim 1 wherein each of said first guide, said second guide, said third guide and said fourth guide comprises a pulley.

5. A projectile launching apparatus as in claim 4 wherein said pulley comprising said first guide and said pulley comprising said second guide are positioned on opposing sides of said barrel and lie in a common plane.

6. A projectile launching apparatus as in claim 4 wherein said pulley comprising said third guide and said pulley comprising said fourth guide lie in a common plane.

7. A projectile launching apparatus as in claim 6 wherein said pulley comprising said third guide and said pulley comprising said fourth guide are positioned in proximity to one another such that said length of elastomeric material led therebetween is entrapped in said common plane.

8. A projectile launching apparatus as in claim 4 wherein said pulley comprising said first guide and said pulley comprising said second guide are positioned on opposing sides of said barrel and lie in a first common plane, and wherein said pulley comprising said third guide and said pulley comprising said fourth guide lie in a second common plane coincident with said first common plane.

9. A projectile launching apparatus, comprising:

a barrel for supporting a projectile prior to and during launch thereof, said barrel having a breech end, a muzzle end and a longitudinal launch axis along which said projectile is launched;

a length of elastomeric material fixed at a first end and at a second end on opposing sides of said barrel aft of said muzzle end;

a first linear actuator aligned parallel to said barrel and joined to provide actuation with respect to said barrel;

a first pulley mounted on said first linear actuator for linear movement therewith to positions forward of said first end of said length of elastomeric material;

a second linear actuator aligned parallel to said barrel and on an opposite side of said barrel relative to said first linear actuator, and joined to said barrel to provide actuation with respect to said barrel;

a second pulley mounted on said second linear actuator for linear movement therewith to positions forward of said second end of said length of elastomeric material;

a third pulley;

a fourth pulley;

a frame for fixing said fourth pulley aft of said third pulley along said longitudinal launch axis such that said third pulley and said fourth pulley are capable of rotation in a common plane, said frame being slidably disposed within said barrel to move along said longitudinal launch axis; and said length of elastomeric material extending from said first end to said second end along a path about said first pulley, between said third pulley and said fourth pulley, and about said second pulley, whereby said third pulley and said fourth pulley can be simultaneously drawn towards said breech end via said frame to stretch said length of elastomeric material to create a potential for accelerating said projectile towards said muzzle end when said projectile is placed forward of said third pulley.

10. A projectile apparatus as in claim 9 further comprising a locking mechanism mounted at said breech end cooperating with said frame to maintain said frame near said breech end when said length of elastomeric material is stretched, and releasing said frame when said projectile is to be launched.

11. A projectile launching apparatus as in claim 10 further comprising means for guiding said frame along said longitudinal launch axis when said frame is released by said locking mechanism.

12. A projectile launching apparatus as in claim 9 wherein said third pulley and said fourth pulley are positioned in proximity to one another such that said length of elastomeric material led therebetween is entrapped between said third pulley and said fourth pulley in said common plane.

13. A projectile launching apparatus as in claim 9 wherein said first linear actuator and said second linear actuator lie in said common plane.

* * * * *